US007611663B2

(12) United States Patent
Zulehner et al.

(10) Patent No.: US 7,611,663 B2
(45) Date of Patent: Nov. 3, 2009

(54) INDUSTRIAL FURNACE AND ASSOCIATED JET ELEMENT

(75) Inventors: Uwe Zulehner, Kempen (DE); Hans Rinnhofer, Euskirchen (DE)

(73) Assignee: Andritz Maerz GmbH (DE)

( * ) Notice: Subject to any disclaimer, the term of this patent is extended or adjusted under 35 U.S.C. 154(b) by 497 days.

(21) Appl. No.: 10/573,172

(22) PCT Filed: Oct. 14, 2004

(86) PCT No.: PCT/EP2004/011525

§ 371 (c)(1),
(2), (4) Date: Mar. 22, 2006

(87) PCT Pub. No.: WO2005/038372

PCT Pub. Date: Apr. 28, 2005

(65) Prior Publication Data

US 2006/0273500 A1 Dec. 7, 2006

(30) Foreign Application Priority Data

Oct. 15, 2003 (DE) ..... 103 47 947

(51) Int. Cl.

| | |
|---|---|
| ***C21C 5/48*** | (2006.01) |
| ***C21B 7/24*** | (2006.01) |
| ***C21C 7/00*** | (2006.01) |
| ***C21B 7/16*** | (2006.01) |
| ***C21B 7/04*** | (2006.01) |
| ***C21B 7/06*** | (2006.01) |
| ***C21C 5/44*** | (2006.01) |

(52) U.S. Cl. ..... 266/218; 266/99; 266/100; 266/217; 266/220; 266/265; 266/268; 266/280

(58) Field of Classification Search ..... 266/99, 266/100, 217, 220, 265, 268, 280, 218
See application file for complete search history.

(56) References Cited

U.S. PATENT DOCUMENTS

| | | | | |
|---|---|---|---|---|
| 2,933,259 | A * | 4/1960 | Raskin | 239/405 |
| 3,330,645 | A | 7/1967 | de Moustier et al. | 75/60 |
| 4,721,287 | A | 1/1988 | Winkelman | 266/47 |
| 5,371,759 | A * | 12/1994 | Wells et al. | 373/72 |
| 5,465,942 | A * | 11/1995 | Wells et al. | 266/46 |

FOREIGN PATENT DOCUMENTS

| | | |
|---|---|---|
| DE | 1246782 | 8/1967 |
| DE | 1433398 | 11/1968 |
| DE | 2503672 | 9/1975 |
| DE | 4130397 | 3/1993 |

* cited by examiner

*Primary Examiner*—Roy King
*Assistant Examiner*—Caitlin Fogarty
(74) *Attorney, Agent, or Firm*—Kusner & Jaffe

(57) ABSTRACT

The present invention relates to an industrial furnace for smelting metals, in particular nonferrous metals, and the respective nozzle element.

13 Claims, 2 Drawing Sheets

INDUSTRIAL FURNACE AND ASSOCIATED JET ELEMENT

Figure 1:
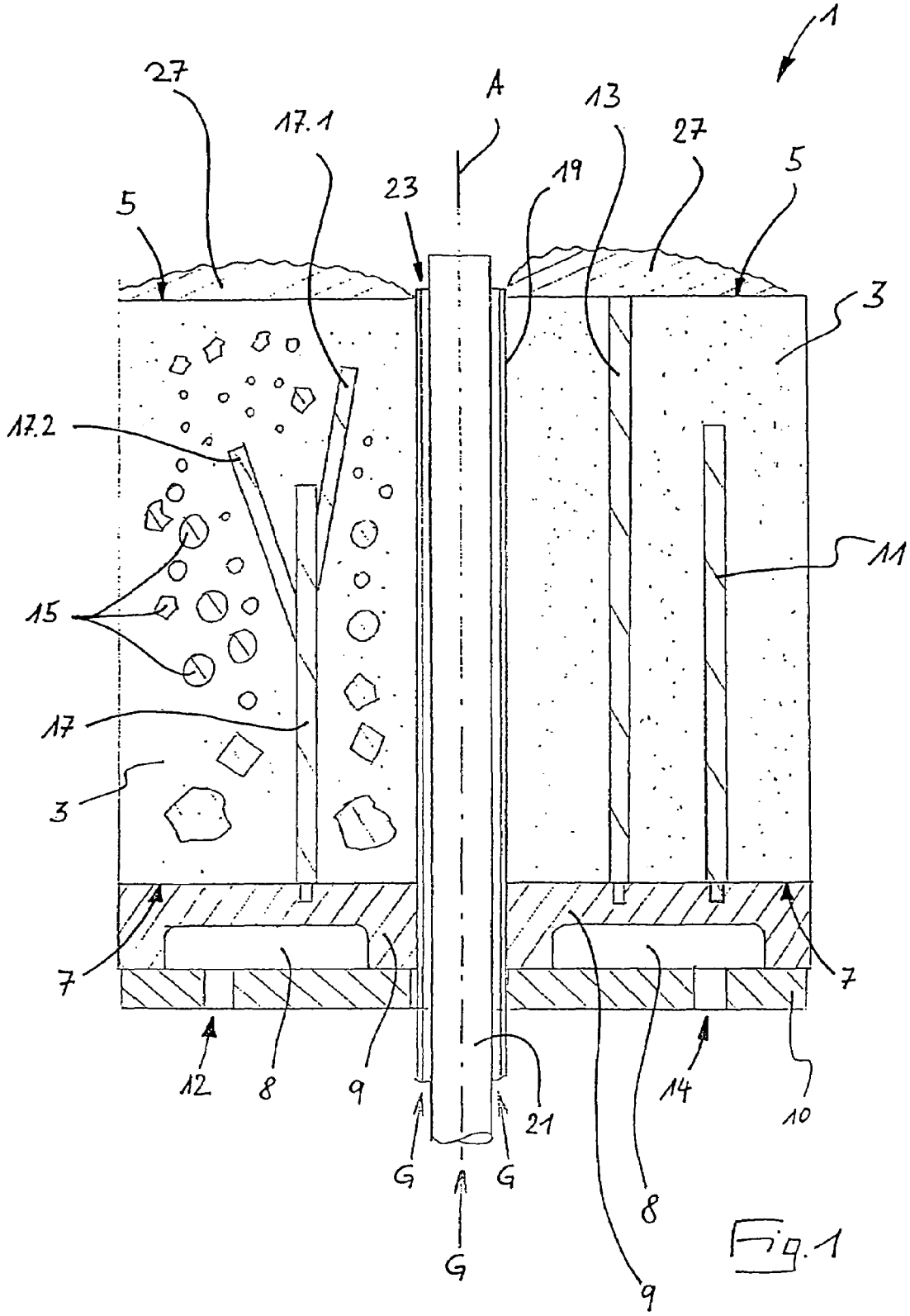

The present invention relates to an industrial furnace for smelting metals, in particular nonferrous metals, and the respective nozzle element.

During the melting operation in an industrial furnace for melting metals, it is often necessary to treat the metal melt by introducing gases or other media.

Corresponding treatment media are regularly injected through nozzles into the metal melt. Such nozzles may be designed as either under-bath nozzles (where the treatment medium is injected into the metal melt below the surface of the bath) or above-bath nozzles (where the treatment medium is injected into the interior of the furnace above the bath surface). The nozzles that are used are usually made of a metal pipe that is passed through the outside wall of the industrial furnace into the interior of the furnace. On the inside of the furnace, a nozzle insert is usually attached to the metal pipe of the nozzle. The outside wall of such industrial furnaces is made of an outer steel jacket which is lined with a refractory material on the inside. The metal is smelted in the furnace interior formed by the refractory lining.

In the areas where the nozzles open into the interior of the furnace, the refractory material surrounding the nozzles in this area usually shows increased wear. This increased wear is due to in particular an elevated variable temperature in the area of the nozzle mouth, resulting in flaking of the refractory lining. Furthermore, there are increased flow movements of the partial melts in the area of the mouth of the nozzle, leading to mechanical erosion of the refractory lining.

This wear on the refractory lining leads not only to problems in care of the refractory lining up to a reduced stability of the lining of the entire furnace but as well to problems with regard to repeatability and therefore the profitability of the injection process because with the change in the geometry of the refractory lining in the area of the nozzle mouth, there are also changes in the flow conditions of the metal melt in the furnace.

The object of the present invention is to make available an industrial furnace for smelting metals, in particular nonferrous metals, as well as a respective nozzle element with which the wear on the refractory material in the area of the nozzle can be reduced.

According to this invention, a nozzle element having the following features for introducing gas into an industrial furnace for smelting metals is made available:

- a nozzle body made of a refractory material;
- a metal jacket covering the refractory material on the cold side of the nozzle body;
- heat-conducting elements which are in contact with the metal jacket and extend into the refractory material;
- the metal jacket is coolable;
- a nozzle pipe (external nozzle pipe) which extends through the metal jacket and the nozzle body from the cold side to the hot side of the nozzle body.

Manufacture of the inventive nozzle element is based on the finding that the wear on the refractory material in the area of the nozzle can be reduced in particular by the fact that "scale," i.e., an incrustation of solidified metal melt, is formed on the hot side of the refractory material in the area of the nozzle. This incrustation consists essentially of slag and metal and protects the refractory material beneath it from wear in the area around the nozzle.

Within the scope of the present invention, it has been found that solidification of the metal melt in the area of the material surrounding the nozzle and thus the formation of an incrustation on the refractory material in this area can be induced by intensified cooling of the refractory material in this area.

To cool the refractory material in the area of the nozzle, heat-conducting elements consisting of a material having an increased thermal conductivity in comparison with the refractory material are provided. The heat-conducting elements are in contact with the metal jacket on the cold side of the nozzle body, so the heat-conducting elements are able to absorb heat and convey it rapidly to the metal jacket. The heat is released from the metal jacket to the outside. To improve the release of heat from the metal jacket to the outside, the metal jacket can be cooled, e.g., by a cooling medium.

The nozzle element may be designed as a separate element.

The hot side of the nozzle body of the nozzle element and its cold side run at a distance from and preferably also parallel to one another. The hot side and the cold side of the nozzle body may have the same or different shapes. For example, the hot side and the cold side may each be round, oval, quadrilateral or polygonal. If the hot side and the cold side are each round, they may each have the same diameter, for example, so that the nozzle body on the whole has the shape of a cylinder or the hot side may have a smaller diameter than the cold side so that the nozzle body tapers conically from the cold side to the hot side. Therefore, the nozzle element can easily be inserted into a corresponding opening in the outside wall of an industrial furnace. To the extent to which the cold side and the hot side each have a quadrilateral shape, the nozzle body has a cuboid shape, e.g., the shape of a cube, on the whole. The side faces of the nozzle body connecting the cold side and the hot side may be covered by a sheet metal jacket.

According to this invention, the term "hot side" is understood to refer to the side of the nozzle body facing the interior of the furnace and thus the metal melt (when the nozzle element is installed in an industrial furnace). The term "cold side" is understood accordingly to refer to the opposite side of the nozzle body, i.e., the side of the nozzle body facing away from the interior of the furnace.

The nozzle element is designed for introducing gas or other media, e.g., solids such as powders or the like into the metal melt.

The nozzle body may be made of any refractory material, e.g., an oxide-ceramic material or a non-oxide-ceramic material, e.g., an oxide-ceramic refractory composition.

On the cold side, the refractory material of the nozzle body is covered by a metal jacket. This metal jacket may be made of copper or steel, e.g., stainless steel, for example, and may be joined to the refractory material of the nozzle body by an anchor or a refractory material. The metal jacket may be of such dimensions that, when the nozzle element is inserted into the outside wall of an industrial furnace, it is in flush contact with the outer metal jacket of the furnace so that the metal jacket of the nozzle element and the outer metal jacket of the furnace form a continuous surface.

The metal jacket is in contact (on its side facing the nozzle body) with heat-conducting elements which extend into the refractory material and in the direction of the hot side of the nozzle body.

The heat-conducting elements may have any desired shape, e.g., they may be in the form of rods, prisms, webs or plates. For example, heat-conducting elements in the form of rods with a star-shaped cross section may be used; corresponding rods have a relatively large surface area, so that a good heat transfer to the heat-conducting elements can be achieved. According to another embodiment, the heat-conducting elements may have a tree-like structure. In this embodiment, the heat-conducting element thus branches off in the direction of the hot side of the nozzle body. These "branches" can absorb heat well in the area of the hot side of the nozzle body and convey it over the (common) "trunk" to the metal jacket.

The heat-conducting elements may be arranged directly on the metal jacket, for example, and may be designed in one piece with the metal jacket, e.g., in the form of "cooling ribs," for example. The heat-conducting elements may also be attached directly to the metal jacket by a welded, a screw connection or some other connection.

According to an alternative embodiment, the heat-conducting elements are not in direct contact with the metal jacket but instead they conduct the heat over the intermediate areas of refractory material to the metal jacket. For example, the corresponding heat-conducting elements may consist of one or more or a plurality of individual bodies which are embedded in the refractory material. According to one embodiment, a plurality of heat-conducting elements is provided in the form of small bodies, which are distributed over the refractory material and embedded in it. Due to this arrangement of this dispersed distribution of heat-conducting elements in the refractory material, the thermal conductivity of the refractory material is increased in this area on the whole so that the heat is conducted more rapidly to the metal jacket in the area of the bodies distributed in the refractory material than it is in the areas of the refractory material where no corresponding bodies are arranged.

The ends of the heat-conducting elements facing the hot side of the nozzle body may end at a distance from the hot side, i.e., in the refractory material or they may continue up to the hot side directly and then form a for example flush area with the hot side of the nozzle body.

The heat-conducting elements and the metal jacket are preferably made of the same material, i.e., copper, steel or stainless steel, for example. A nozzle pipe (hereinafter also referred to as "outer nozzle pipe") extends through the metal jacket and the nozzle body from the cold side to the hot side of the nozzle body.

This outer nozzle pipe serves to convey gas or other treatment media into the metal melt—optionally in combination with one or more other pipes for conducting gas. The outer nozzle pipe may be made of a metal in particular, e.g., stainless steel, preferably has a circular inner (free) cross-sectional area and extends in particular along a longitudinal axis running linearly.

The outer nozzle element may be connected to the nozzle body by a refractory material, for example.

Another nozzle pipe, referred to below as the "inner nozzle pipe," may be arranged in the outer nozzle pipe. The inner nozzle pipe is preferably arranged displaceably in the outer nozzle pipe, so that it is displaceable along its longitudinal axis which runs coaxially with the longitudinal axis of the outer nozzle pipe, for example.

A corresponding inner nozzle pipe arranged in the outer nozzle pipe displaceably along its longitudinal axis has a great advantage. Instead of an inner nozzle pipe, the generic nozzles used in the past have had a nozzle insert which is placed on the hot side of the (outer) nozzle pipe. Then a defined nozzle shape can be established on the hot side of the nozzle pipe through the use of this nozzle insert. The nozzle insert could be used for only one batch because of the scale buildup, so the nozzle insert would have to be removed from the nozzle pipe after each melting operation and replaced by a new nozzle insert. This replacement operation was very time-consuming. In the outer nozzle pipe according to this invention, an inner nozzle pipe is displaceably arranged so the inner nozzle pipe can be readjusted continuously from the outside in accordance with its wear. This eliminates the replacement operation that was necessary in the past.

The inner nozzle pipe has a defined inner (free) cross-sectional area, making it possible to adjust the conditions for introducing the gas directed through the inner nozzle pipe into the metal melt.

The inner nozzle pipe is preferably arranged inside the outer nozzle pipe at a distance from it. This defines a gap between the inner and outer nozzle pipes which may also be used for introducing gas into the metal melt. The inner nozzle pipe and the outer nozzle pipe may be kept a distance apart by means of spacers. These spacers may consist of, for example, nubby protrusions arranged on the surface of the outer nozzle pipe facing the inner nozzle pipe. Protrusions which engage in corresponding guide elements, e.g., rails or grooves arranged on the outside surface of the inner nozzle pipe, may also be provided on the surface of the outer nozzle pipe facing the inner nozzle pipe. These guide elements may be arranged, e.g., parallel to the longitudinal axis or in a helical pattern on the surface of the inner nozzle pipe so that the inner nozzle pipe can be guided reliably in the outer nozzle pipe in the longitudinal direction or in a helical pattern.

In an alternative embodiment, the outer circumferential surface of the inner nozzle pipe has an outside thread which engages in the inside thread arranged on the surface of the outer nozzle pipe facing the inner nozzle pipe.

The outer and inner nozzle pipes are each designed so that the gap, i.e., the inner free cross section of the inner nozzle pipe remaining between the outer and inner nozzle pipes can be brought into contact with a gas or some other source of a medium that can be introduced into the gap and/or into the inner free cross section of the inner nozzle pipe.

The readjustment, i.e., movement of the inner nozzle pipe in the outer nozzle pipe, may be performed manually or automatically, e.g., with an electric drive, a hydraulic drive or a pneumatic drive. The readjustment process may essentially be performed incrementally or continuously and may be coordinated with the metallurgical treatment time, e.g., with a preset rate of advance that is set in advance. In the case of a continuous residual thickness measurement of the nozzle, the rate of advantage may be adapted continuously to the wear conditions prevailing on the inner nozzle pipe. The gap between the inner and outer nozzle pipes may be equipped with a suitable lubricant, e.g., to minimize torsional stresses.

According to one exemplary embodiment, the outer circumferential surface of the inner nozzle pipe and the surface of the outer nozzle pipe facing the former surface are in direct contact with one another. In this case, no gas is passed through this gap. A lubricant provided in this gap may then also serve to provide a seal.

It is possible for the heat-conducting elements to be arranged in the refractory material of the nozzle body in such a way that they are arranged essentially in a ring pattern around the outer nozzle pipe.

The risk of wear on the refractory material increases with an increase in proximity to the mouth of the outer nozzle pipe on the hot side of the nozzle body, so the nozzle element according to the present invention may be manufactured in such a way that a thicker incrustation can develop on the hot side of the nozzle body in immediate proximity to the mouth of the outer nozzle pipe than is the case in the areas at a greater distance from said mouth.

It is possible to provide for the thermal conductivity in the areas of the nozzle body directly adjacent to the outer nozzle pipe to be greater than that in the areas at a greater distance therefrom.

According to the present invention, it is possible to provide, for example, for the heat-conducting elements in the area of the nozzle body closer to the outer nozzle pipe to be guided closer to the hot side of the nozzle body than the areas at a greater distance from the outer nozzle pipe. The dissipation of heat then increases in the direction of the mouth of the outer nozzle pipe on the hot side of the nozzle body. Accordingly, the thickness of the incrustation also increases in this direction.

The heat-conducting elements may be designed with steps accordingly, with the step height decreasing in the direction away from the outer nozzle pipe—with respect to the hot side of the nozzle body.

To dissipate the heat supplied by the heat-conducting elements to the metal jacket away from the metal jacket, the metal jacket may be designed to be cooled by a fluid, in particular water or some other cooling medium.

To do so, the metal jacket may be equipped with devices, e.g., devices through which a fluid can be passed over the surface of the metal jacket or through the metal jacket.

The extent of dissipation of heat from the metal jacket outward is adjustable through the cooling medium, e.g., via the temperature interval between the metal jacket (hotter) and the cooling medium (colder) and/or via the amount of cooling medium flowing past the metal jacket and/or through the choice of the coolant medium per se (choice of a cooling medium having a specific thermal capacity). A greater dissipation of heat from the metal jacket outward results in an increased dissipation of heat from the hot side of the nozzle body toward the outside, which is in turn associated with an increased buildup of incrustation on the hot side.

Meanwhile, the formation of incrustation can be controlled through the type and manner of cooling of the metal jacket.

The nozzle element according to the present invention is designed for installation in any industrial furnace for smelting metals, but in particular for installation in an industrial furnace for melting nonferrous metals.

The nozzle element may be designed as an under-bath nozzle or as an over-bath nozzle.

Finally, the present invention also includes an industrial furnace having an inventive nozzle element situated in its outer wall. The industrial furnace may have an opening in its outer wall, so that an inventive nozzle element can be inserted through this opening.

Additional features of the present invention are derived from the other patent application documents, in particular the figures, as well as the following description of the figures.

All the features of the nozzle element disclosed in the present patent application may be combined together in any desired manner.

The description of the figures illustrates an exemplary embodiment of an inventive nozzle element.

They show:

FIG. 1 a nozzle element in a sectional view from the side and

Figure 2:
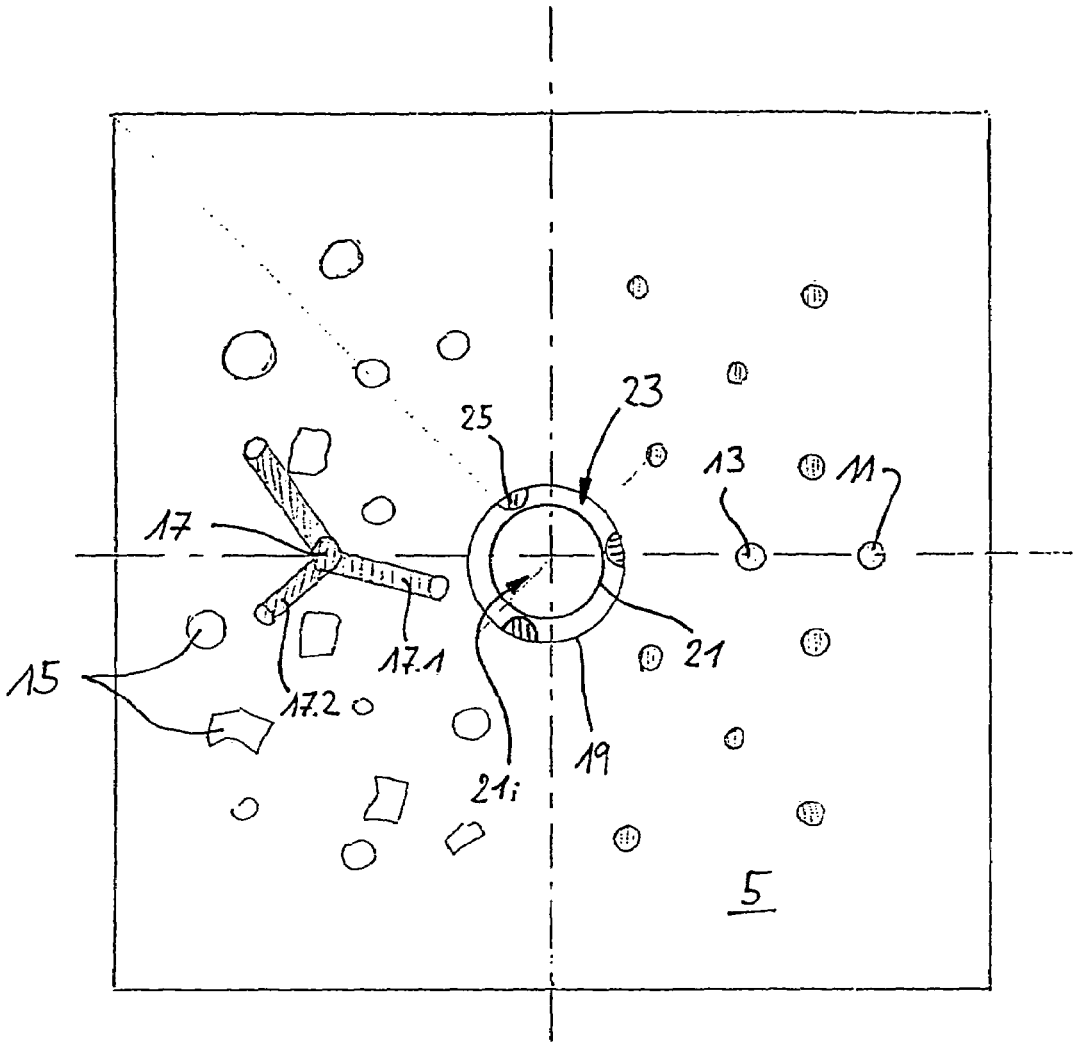

FIG. 2 a view of the hot side of the nozzle element according to FIG. 1 as seen from above.

The nozzle element in FIG. 1 is labeled as 1 in its entirety.

The nozzle body 3 of the nozzle element 1 made of a refractory material has an essentially cubical shape on the whole, with a square hot side 5 and a square cold side 7.

On the cold side 7 the refractory material of the nozzle body 3 is covered by a metal jacket 9 of copper. Channel-like recesses 8 are formed in the metal element 9 on the surface side of the metal element 9 facing away from the nozzle body 3. The channel-like recesses 8 are covered with respect to the outside by covering plates 10 so that the channel-like recesses 8 are closed on all sides. The cover plates 10 have an inlet opening 12 leading into the channel-like recesses 8 and an outlet opening 14 leading out of the recesses.

Various heat-conducting elements 11, 13, 15, 17, 17.1, 17.2 made of copper are in contact with the metal jacket 9 and extend into the refractory material of the nozzle body 3 in the direction of its hot side 5.

On the right side in FIG. 1 can be seen two rod-shaped heat-conducting elements 11, 13 which extend perpendicularly from the metal jacket 9 into the refractory material and extend in the direction of the hot side 5 of the nozzle body 3. The rod-shaped heat-conducting elements 11, 13 have steps, whereby the heat-conducting element 13 which closer to the nozzle pipe 19 is guided directly to the hot side 5 of the nozzle body 3 and the heat-conducting element 11 which is at a greater distance from the outer nozzle pipe 19 runs out at a distance from the hot side 5 in the refractory material.

The heat-conducting elements 11, 13 are inserted into the metal jacket 9.

On the left side in FIG. 1, a tree-like heat-conducting element 17, 17.1, 17.2 extends at first from the metal jacket 9 into which it is likewise inserted, extending into the refractory material of the nozzle body 3 in the direction of the hot side 5 of the nozzle body 3.

Starting from the "trunk" 17, the heat-conducting element 17, 17.1, 17.2 branches off via two branches 17.1, 17.2 in the direction of the hot side 5. The branches 17.1, 17.2 end at a distance from the hot side 5 in the refractory material. The branches 17.1, 17.2 are also designed with steps, where the step height decreases from the branch 17.1 arranged nearer to the outer nozzle pipe 19 to the branch 17.2 which is at a greater distance away from the outer nozzle pipe 19.

Furthermore, on the left side of FIG. 1 can be seen heat-conducting elements 15 in the form of several individual geometric bodies 15 that are distributed throughout the refractory material. Due to these bodies 15, the thermal conductivity of the refractory material of the nozzle body 3 is increased on the whole in the area where the bodies 15 are distributed. The heat is not conducted directly to the metal jacket 9—as is the case with the heat-conducting elements 11, 13, 17, 17.1. 17.2—but also over several intermediate areas of the refractory material.

FIG. 1 shows different inhomogeneously arranged embodiments of heat-conducting elements 11, 13 and/or 15, 17, 17.1, 17.2 on the right and left sides of the nozzle body 3.

In the practical embodiment, however, a homogeneous combination of heat-conducting elements is preferred. For example, different embodiments of heat-conducting elements may be distributed homogeneously around the outer nozzle pipe 19. For example, stepped heat-conducting elements in the form of rods and/or trees and/or plates arranged in a ring around the outer nozzle pipe 19 may also be surrounded by heat-conducting elements in the form of individual bodies 15 distributed over the refractory material.

The outer nozzle pipe 19 extends from the cold side 7 to the hot side 5 of the nozzle body by passing through the metal jacket 9 and the nozzle body 3. The outer nozzle pipe 19 is made of stainless steel and runs so that it is rotationally symmetrical with its longitudinal axis A which is perpendicular to the hot side 5 and the cold side 7 of the nozzle body 3.

An inner nozzle pipe 21 made of stainless steel is arranged inside the outer nozzle pipe 19 and concentric with it. The longitudinal axis A of the inner nozzle pipe 21 runs coaxially with the longitudinal axis A of the outer nozzle pipe 19. The outer nozzle pipe 19 and the inner nozzle pipe 21 run with a distance from one another, thereby defining a ring gap 23 in the space between two pipes 19, 21.

Nubby protrusions (not shown here) are arranged on the surface of the outer nozzle pipe 19 facing the outer circumferential surface of the inner nozzle pipe 21, holding the inner nozzle pipe 21 and the outer nozzle pipe 19 at a constant distance from one another.

With a drive mechanism (not shown), the inner nozzle pipe 21 is rotated about the longitudinal axis A on the one hand and at the same time is displaced along its longitudinal axis A in the direction of the hot side 5 on the other hand.

FIG. 2 shows the nozzle element 1 according to FIG. 1 in a view of the hot side 5 as seen from above.

The mouth of the outer nozzle pipe 19 is arranged at the center of the quadratic hot side 5. The inner nozzle pipe 21 is concentric with the longitudinal axis A in the interior of the outer nozzle pipe 19. The outer nozzle pipe 19 and the inner nozzle pipe 21 are held at a constant distance by nubby protrusions 25 arranged on the surface of the outer nozzle pipe 19 facing the inner nozzle pipe 21. Due to this constant distance, an annular gap 23 is defined between the outer nozzle pipe 19 and the inner nozzle pipe 21.

The gas can be passed through the free interior cross section 21*i* in the interior of the inner nozzle pipe 21 and the gap 23 and it can be introduced into a metal melt which is in contact with the nozzle element 1 on the hot side 5.

Furthermore FIG. 2 shows the heat-conducting elements 11, 13, 15, 17, 17.1, 17.2 and other heat-conducting elements surrounding the outer nozzle pipe 21 in the form of a ring.

The function of the nozzle element shown here is as follows: If the hot side 5 of the nozzle body 3 is in contact with a metal melt in a melting process, then a cooling medium is introduced through the inlet opening 12 into the channel-like recesses 8 in the metal jacket 9 and discharged out through the outlet opening 14. Therefore the heat absorbed by the heat-conducting elements 11, 13, 15, 17, 17.1, 17.2 and relayed to the metal jacket 9 can be dissipated away from the metal jacket 9 again rapidly. Owing to this effective dissipation of heat in the area of the hot side 5, the metal melt solidifies in this area. This solidified metal melt forms an incrustation 27 on the hot side 5 of the nozzle body 3. The refractory material of the nozzle body 3 beneath that is protected from wear by this incrustation 27.

For treatment of the metal melt with gas, gas is introduced into the gap 23 and into the free cross section 21*i* of the inner nozzle pipe 21 in the area of the cold side 7 of the nozzle body 3 (indicated by the arrows G), so that the gas passes through the gap 23 and the free interior 21*i* and reaches the hot side 5 of the nozzle body 3, where it is injected into the metal melt.

The invention claimed is:

1. A nozzle element for introducing gas into an industrial furnace for melting metals, having the following features:

a) a nozzle body (3) made of a refractory material having a hot side (5) and a cold side (7);

b) a metal jacket (9) covering the refractory material on the cold side (7) of the nozzle body (3);

c) heat-conducting elements (11, 13, 15, 17/17.2) which are in contact with the metal jacket (9) and extend into the refractory material whereby the heat-conducting elements (11, 13, 15, 17.1, 17.2)) are able to absorb heat and convey it rapidly to the metal jacket (9), said heat-conducting elements (11, 15, 17, 17.1, 17.2) each having an end that faces the hot side (5) of the nozzle body (3) and that is disposed a distance from the hot side (5) of the nozzle body (3);

d) the metal jacket (9) is coolable; and e) an outer nozzle pipe (19) which extends through the metal jacket (9) and the nozzle body (3) from the cold side (7) to the hot side (5) of the nozzle body (3).

2. The nozzle element according to claim 1, wherein in the metal jacket (9) and the heat-conducting elements (11, 13, 15, 17, 17.1, 17.2) are all made of the same material.

3. The nozzle element according to claim 1, wherein the metal jacket (9) and heat-conducting elements (11, 13, 15, 17, 17.1, 17.2) are made of copper or stainless steel.

4. The nozzle element according to claim 1, wherein the heat-conducting elements (11, 13, 15, 17, 17.1, 17.2) are arranged essentially in a ring-like pattern around the outer nozzle pipe (19).

5. The nozzle element according to claim 1, wherein heat-conducting elements (11, 13, 15, 17, 17.1, 17.2) are provided in the form of rods, webs or plates.

6. The nozzle element according to claim 1, wherein the metal jacket (9) can be cooled by a cooling medium.

7. The nozzle element according to claim 1, wherein a device is provided through which a fluid can be passed over the surface of the metal jacket (9) or through the metal jacket (9).

8. The nozzle element according to claim 7, wherein a channel-shaped device (8) is provided for conducting the fluid.

9. The nozzle element according to claim 1 with an inner nozzle pipe (21) displaceably arranged in the outer nozzle pipe (19) along its longitudinal axis (A).

10. The nozzle element according to claim 1, wherein an inner nozzle pipe (21) is arranged inside the outer nozzle pipe (19) and at a distance from it.

11. The nozzle element according to claim 10, wherein the inner nozzle pipe (21) and the outer nozzle pipe (19) are held at a distance from one another by spacers.

12. The nozzle element according to claim 1, wherein the outer circumferential surface of an inner nozzle pipe (21) has a thread which engages in an inside thread arranged on the surface of the outer nozzle pipe (19) facing the inner nozzle pipe (21).

13. The industrial furnace, wherein a nozzle element according to claim 1 is arranged in its outside wall.

* * * * *

UNITED STATES PATENT AND TRADEMARK OFFICE

CERTIFICATE OF CORRECTION

PATENT NO. : 7,611,663 B2
APPLICATION NO. : 10/573172
DATED : November 3, 2009
INVENTOR(S) : Zulehner et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 548 days.

Signed and Sealed this

Twelfth Day of October, 2010

David J. Kappos

David J. Kappos
*Director of the United States Patent and Trademark Office*